US005958871A

United States Patent [19]

Clare

[11] Patent Number: 5,958,871

[45] Date of Patent: Sep. 28, 1999

[54] DETERGENT COMPOSITION BASED ON ZEOLITE-BICARBONATE BUILDER MIXTURE

[75] Inventor: Jonathan Richard Clare, Newcastle upon Tyne, United Kingdom

[73] Assignee: The Procter & Gamble Company, Cincinnati, Ohio

[21] Appl. No.: 09/043,555

[22] PCT Filed: Sep. 26, 1996

[86] PCT No.: PCT/US96/15452

§ 371 Date: Jun. 10, 1998

§ 102(e) Date: Jun. 10, 1998

[87] PCT Pub. No.: WO97/12025

PCT Pub. Date: Apr. 3, 1997

[30] Foreign Application Priority Data

Sep. 26, 1995 [GB] United Kingdom ..... 9519607

[51] Int. Cl.[6] ..... C11D 3/12; C11D 3/10

[52] U.S. Cl. ..... 510/507; 510/276; 510/315; 510/323; 510/509; 510/532

[58] Field of Search ..... 510/117, 315, 510/323, 507, 509, 532, 377, 276; 252/FOR 246, FOR 236, 276

[56] References Cited

U.S. PATENT DOCUMENTS

| | | | |
|---|---|---|---|
| 4,304,675 | 12/1981 | Corey et al. | 8/142 |
| 4,311,607 | 1/1982 | Kaeser | 510/532 |
| 4,349,533 | 9/1982 | Dent et al. | 424/52 |
| 4,399,048 | 8/1983 | Gangwisch et al. | 510/323 |
| 4,647,451 | 3/1987 | Piechota, Jr. | 424/52 |
| 5,259,981 | 11/1993 | Chappel et al. | 510/312 |
| 5,259,982 | 11/1993 | Chappel et al. | 510/315 |
| 5,374,370 | 12/1994 | Brown et al. | 510/220 |
| 5,409,627 | 4/1995 | Boskamp et al. | 510/311 |

FOREIGN PATENT DOCUMENTS

| | | | |
|---|---|---|---|
| 0 653 481 A1 | 5/1995 | European Pat. Off. | C11D 3/12 |
| WO 95/02036 | 1/1995 | WIPO | C11D 17/06 |
| WO 95/16016 | 6/1995 | WIPO | C11D 1/83 |

*Primary Examiner*—Ardith Hertzog

*Attorney, Agent, or Firm*—Jacobus C. Rasser; Kim W. Zerby; D. Mitchell Goodrich

[57] ABSTRACT

A detergent composition is provided which contains a zeolite builder having a particle size, $d_{50}$ of less than 1 micrometer; and a bicarbonate builder. The zeolite builder and bicarbonate builder are present in a ratio of from 5:1 to 1:1. Low levels of carbonate builder may be present such that the weight ratio of carbonate builder to the bicarbonate builder is less than 1:1.

10 Claims, No Drawings

DETERGENT COMPOSITION BASED ON ZEOLITE-BICARBONATE BUILDER MIXTURE

The present invention relates to a detergent composition comprising both zeolite as a sequestering agent for water hardness and bicarbonate builder.

Detergent compositions for fabric washing conventionally contain detergency builders which lower the concentration of calcium and magnesium water hardness ions in the wash liquor and thereby provide good detergency effect in both hard and soft water.

Conventionally, inorganic phosphates, such as sodium tripolyphosphate, have been used as builders for laundry detergents. More recently, alkali metal aluminosilicate ion-exchangers, particularly crystalline sodium aluminosilicate zeolite A, have been proposed as replacements for the inorganic phosphates.

For example, EP 21 491A (Procter & Gamble) discloses detergent compositions containing a building system which includes zeolite A, X or P (B) or a mixture thereof. EP 384070A (Unilever) discloses specific zeolite P materials having an especially low silicon to aluminium ratio not greater than 1.33 (hereinafter referred to as zeolite MAP) and describes its use as a detergency builder.

Zeolite builders are typically used in detergent compositions with cobuilders to provide optimum building capacity for the detergent composition as a whole. Carbonate is a particularly commonly used cobuilder, which is favoured in part, for its ability to provide both building capacity and alkalinity to a wash solution.

The Applicants have now surprisingly found that a problem may occur when a water insoluble zeolite having a small particle size, is used as a detergency builder in a fabric laundering detergent composition also containing relatively high levels of carbonate cobuilder. The problem has been found to be particularly pronounced when the zeolite builder is zeolite MAP.

The choice of a small particle size for a zeolite MAP component, that is to say particles having a particle size, measured as a $d_{50}$ value, of up to 1.0 micrometers has previously been taught to be preferred in the art, as represented, for example, by EP 384070 A.

The problem relates to the aforementioned detergent compositions having a marked incompatibility with printed cotton fabrics. In particular, it has been found that the use of detergent compositions containing small particle size zeolite tends to lead to the removal of printed pigment from a printed cotton fabric surface. The presence of relatively high levels of carbonate cobuilder has been found to exarcebate this effect.

The Applicant has surprisingly found that this problem can be ameliorated by the partial or complete replacement of the carbonate component of the detergent composition by a bicarbonate builder component.

The present invention is thus based on the unexpected finding that the printed cotton fabric care profile of a detergent composition comprising zeolite of small particle size, bicarbonate builder and relatively low levels of carbonate builder is superior to that of comparably alkaline and built compositions containing principally carbonate cobuilder.

This finding allows the formulation of detergent compositions providing both excellent cleaning and printed fabric care properties on cotton fabrics.

Whilst the prior art, as represented for example by European Patent Aplications, EP 384070 A, EP 448297 A, EP 522726 A, EP 533392 A, EP 544492 A, EP 552053 A, and EP 552054 A has envisaged the use of cobuilders in combination with zeolite in laundry detergent compositions, none of these prior art documents specifically disclose the use of bicarbonate cobuilder with a small particle size zeolite component. Furthermore, none of these prior art documents provides any teaching relating to the printed cotton fabric care problem addressed by the current invention, nor of any solution thereto involving the selection of a particular bicarbonate cobuilder component.

Thus, the present invention provides a detergent composition containing (a) a zeolite builder having a particle size, $d_{50}$, of less than 1.0 micrometers;

(b) a bicarbonate builder; and optionally (c) a carbonate builder wherein the weight ratio any carbonate builder to the bicarbonate builder is less than 4:1.

In a preferred embodiment of the invention the zeolite builder comprises zeolite P having a silcon to aluminium ratio of not greater than 1.33 (zeolite MAP).

In a further preferred embodiment the detergent composition according to the invention is formulated to be especially useful in the laundering of coloured fabrics and preferably is free of bleach. According to another aspect of the invention, the composition is substantially free of an optical brightener.

Zeolite builder

The first essential component of the present invention is an aluminosilicate zeolite builder.

The zeolite builder is typically present at a level of from 1% to 80%, more preferably from 15% to 40% by weight of the compositions.

Suitable aluminosilicate zeolites have the unit cell formula $Na_z[(AlO_2)_z(SiO_2)y]. XH_2O$ wherein z and y are at least 6; the molar ratio of z to y is from 1.0 to 0.5 and x is at least 5, preferably from 7.5 to 276, more preferably from 10 to 264. The aluminosilicate material are in hydrated form and are preferably crystalline, containing from 10% to 28%, more preferably from 18% to 22% water in bound form.

The aluminosilicate zeolites can be naturally occurring materials, but are preferably synthetically derived. Synthetic crystalline aluminosilicate ion exchange materials are available under the designations Zeolite A, Zeolite B, Zeolite P, Zeolite X, Zeolite MAP, Zeolite HS and mixtures thereof.

Zeolite A has the formula $$Na_{12}[AlO_2)_{12}(SiO_2)_{12}]. xH_2O$$

wherein x is from 20 to 30, especially 27. Zeolite X has the formula $Na_{86}[(AlO_2)_{86}(SiO_2)_{106}]. 276\ H_2O$.

Zeolite MAP is described in EP 384070A (Unilever). It is defined as an alkali metal alumino-silicate of the zeolite P type having a silicon to aluminium ratio not greater than 1.33, preferably within the range from 0.9 to 1.33 and more preferably within the range of from 0.9 to 1.2.

Of particular interest is zeolite MAP having a silicon to aluminium ratio not greater than 1.15 and, more particularly, not greater than 1.07.

Zeolite P having a Si:Al ratio of 1.33 or less may be prepared by the following steps:

(i) mixing together a sodium aluminate having a mole ratio $Na_2O:Al_2O_3$ within the range of from 1.4 to 2.0 and a sodium silicate having a mole ratio $SiO_2:Na_2O$ within the range of from 0.8 to 3.4 with vigorous stirring at a temperature within the range of from 25° C. to boiling point usually 95° C., to give a gel having the following composition; $Al_2O_3$: (1.75–3.5) $SiO_2$: (2.3–7.5) $Na_2O$ :P (80–450)$H_2O$;

(ii) ageing the gel composition for 0.5 to 10 hours, preferably 2 to 5 hours, at a temperature within the range of from 70° C. to boiling point, usually to 95° C., with sufficient stirring to maintain any solids present in suspension;

(iii) separating the crystalline sodium aluminosilicate thus formed, washing to a pH within the range of from 10 to 12.5, and drying, preferably at a temperature not exceeding 150° C., to a moisture content of not less than 5 wt. %.

Preferred drying methods are spray-drying and flash-drying. It appears that oven drying at too high a temperature may adversely affect the calcium binding capacity of the product under certain circumstances.

Commercial sodium metasilicate pentahydrate dissolved in water and commercial sodium silicate solution (waterglass) are both suitable silica sources for the production of zeolite P in accordance with the invention. The reactants may be added together in any order either rapidly or slowly. Rapid addition at ambient temperature, and slow addition at elevated temperature (90–95° C.) both give the desired product.

Vigorous stirring of the gel during the addition of the reactants, and at least moderate stirring during the subsequent ageing step, however, appear to be essential for the formation of pure zeolite P. In the absence of stirring, various mixtures of crystalline and amorphous materials may be obtained.

Zeolite MAP generally has a calcium binding capacity of at least 150 mg CaO per g of anhydrous aluminosilcate, as measured by the standard method described in GB 1473201 (Henkel). The calcium binding capacity is normally 160 mg CaO/g and may be as high 170 mg CaO/g.

Although zeolite MAP like other zeolites contains water of hydration, for the purposes of the present invention amounts and percentages of zeolite are expressed in terms of the notional anhydrous material.

The amount of water present in hydrated zeolite MAP at ambient temperature and humidity is generally about 20 wt. %.

The zeolite builder used in the present invention has a particle size $d_{50}$ of less than 1.0 micrometers, preferably from 0.05 to 0.9 micrometers, most preferably from 0.2 to 0.7 micrometers. The $d_{50}$ value indicates that 50% by weight of the particles have a diameter smaller than that figure. The particle size may be determined by conventional analytical techniques such as, for example, microscopic determination utilizing a scanning electron microscope or by means of a laser granulometer.

Zeolite builder having the required particle size according to the present invention can, for example, be prepared by the conventional techniques as described above while adopting one or more of the following steps:

a) decreasing crystallisation time;

b) decreasing the size of the seed crystals used to produce the zeolite;

c) screening the zeolite product to remove coarse material.

An article by D. Vucelic, published in Progr Colloid Polymer Science, 1994, Volume 95, pages 14–38 describes methods for the synthesis of zeolite particles, and in particular how to influence the particle size characteristics of the zeolites by modification of the synthesis process steps.

Bicarbonate builder

In addition to zeolite, the detergent compositions contain bicarbonate builder. By bicarbonate builder it is meant herein any compound capable of releasing bicarbonate ions to a wash solution.

Preferred bicarbonate builders include the alkali and alkaline earth bicarbonate salts, particularly sodium bicarbonate.

The bicarbonate builder is typically present at a level of from 0.5% to 60%, preferably from 2% to 40%, most preferably from 3% to 20% by weight of the detergent composition.

The bicarbonate builder is preferably present at a weight ratio of zeolite builder to bicarbonate builder of from 20:1 to 1:5, more preferably from 10:1 to 2:1, most preferably from 5:1 to 1:1.

Other builders

The detergent compositions may contain other organic or inorganic builders.

In an essential aspect the level of any carbonate builder, that is of inorganic compound capable of releasing carbonate ions into a wash solution, is kept relatively low. In particular, any carbonate builder is present only at a level wherein the weight ratio of the carbonate builder to the bicarbonate builder is less than 4:1, preferably less than 2:1, more preferably less than 1:1. Most preferably the detergent composition is free from carbonate builder.

Suitable organic cobuilders can be monomeric or polymeric carboxylates such as citrates or polymers of acrylic, methacrylic and/or maleic acids in neutralised form.

Suitable inorganic cobuilders include carbonates and amorphous and crystalline layered silicates.

Suitable crystalline layered silicates have the composition:

$$NaMSi_xO_{2x+1}.\ yH_2O$$

where M is sodium or hydrogen, preferably sodium; x is a number from 1.9 to 4; and y is a number from 0 to 20. Such materials are described in U.S. Pat. No. 4,664,839; No. 4,728,443 and No. 4,820,439 (Hoechst AG). Especially preferred are compounds in which x=2 and y=0. The synthetic material is commercially available from Hoechst AG as δ-$Na_2$ $Si_2O_5$ (SKS6) and is described in U.S. Pat. No. 4,664,830.

The total amount of detergency builder in the granular composition typically ranges from 10 to 80 wt. %, more preferably from 15 to 60 wt % and most preferably from 10 to 45 wt. %.

Additional detergent components

The detergent composition according to the invention may contain other detergent components such as surfactants, bleaches, fluorescers, antiredeposition agents, inorganic salts such as sodium sulphate, other enzymes, lather control agents, fabric softening agents, pigments, coloured speckles and perfumes.

Surfactant

The detergent composition according to the invention preferably includes a surfactant selected from anionics, nonionics, zwitterionics, ampholytics and cationics.

The surfactant is preferably present in the detergent compositions at a level of from 1% to 50%, preferably from 3% to 30%, most preferably from 5% to 20% by weight of the compositions.

Many suitable detergent-active compounds are available and fully described in the literature (for example "Surface Active Agents and Detergents" Volumes I and II by Schwartz, Perry and Berch).

Examples of suitable additional anionic surfactants include anionic sulfates, olefin sulphonates, alkyl xylene sulphonates, dialkylsulphosuccinates, and fatty acid ester sulphonates. Sodium salts are generally preferred.

Anionic sulfate surfactant

Anionic sulfate surfactants suitable for use herein include the linear and branched primary alkyl sulfates, alkyl ethoxysulfates, fatty oleoyl glycerol sulfates, alkyl phenol ethylene oxide ether sulfates, the $C_5$–$C_{17}$ acyl-N-($C_1$–$C_4$ alkyl) and —N-$C_1$–$C_2$ hydroxyalkyl) glucamine sulfates, and sulfates of alkylpolysaccharides such as the sulfates of alkylpolyglucoside (the nonionic nonsulfated compounds being described herein).

Alkyl ethoxysulfate surfactants are preferably selected from the group consisting of the $C_6$–$C_{18}$ alkyl sulfates which have been ethoxylated with from 0.5 to 20 moles of ethylene oxide per molecule. More preferably, the alkyl ethoxysulfate surfactant is a $C_6$–$C_{18}$ alkyl sulfate which has been ethoxylated with from 0.5 to 20, preferably from 0.5 to 5, moles of ethylene oxide per molecule.

Anionic sulfonate surfactant

Anionic sulfonate surfactants suitable for use herein include the salts of $C_5$–$C_{20}$ linear alkylbenzene sulfonates, alkyl ester sulfonates, $C_6$–$C_{22}$ primary or secondary alkane sulfonates, $C_6$–$C_{24}$ olefin sulfonates, sulfonated polycarboxylic acids, alkyl glycerol sulfonates, fatty acyl glycerol sulfonates, fatty oleyl glycerol sulfonates, and any mixtures thereof.

Nonionic surfactant

The nonionic surfactant is preferably a hydrophobic nonionic surfactant, particularly an alkoxylated nonionic surfactant, having a hydrophilic lipophilic balance (hlb) value of <9.5, more preferably <10.5.

Examples of suitable hydrophobic alkoxylated nonionic surfactants include alkoxylated adducts of fatty alcohols containing an average of less than 5 alkylene oxide groups per molecule.

The alkylene oxide residues may, for example, be ethylene oxide residues or mixtures thereof with propylene oxide residues.

Preferred alkylene oxide adducts of fatty alcohols useful in the present invention can suitably be chosen from those of the general formula:

$$R—O—(C_nH_{2n}O)yH$$

wherein R is an alkyl or alkenyl group having at least 10 carbon atoms, most preferably from 10 to 22 carbon atoms, y is from 0.5 to 3.5 and n is 2 or 3.

Preferred nonionic surfactants include primary $C_{11}$–$C_{15}$ aliphatic alcohols condensed with an average of no more than five ethylene oxide groups per mole of alcohol, having an ethylene oxide content of less than 50% by weight, preferably from 25% to less than 50% by weight.

A particularly preferred aliphatic alcohol ethoxylated is a primary alcohol having an average of 12 to 15 carbon atoms in the alkyl chain condensed with an average of three ethoxy groups per mole of alcohol.

Specific examples of suitable alkoxylated adducts of fatty alcohols are Synperonic A3 (ex ICI), which is a $C_{13}$–$C_{15}$ alcohol with about three ethylene oxide groups per molecule and Empilan KB3 (ex Marchon), which is lauric alcohol 3EO.

Another class of nonionic sufactants comprises alkyl polyglucoside compounds of general formula $$RO(C_nH_{2n}O)_tZ_x$$

wherein Z is a moiety derived from glucose; R is a saturated hydrophobic alkyl group that contains from 12 to 18 carbon atoms; t is from 0 to 10 and n is 2 or 3; x is from 1.1 to 4, the compounds including less than 10% unreacted fatty alcohol and less than 50% short chain alkyl polyglucosides. Compounds of this type and their use in detergent compositions are disclosed in EP-B 0070074, 0070077, 0075996 and 0094118.

Bleach

Detergent compositions according to the invention may also contain a bleach system. Where present, this preferably comprises one or more peroxy bleach compounds, for example, inorganic persalts or organic peroxyacids, which may be employed in conjunction with bleach precursors to improve bleaching action at low temperatures.

The bleach system preferably comprises a peroxy bleach compound, preferably an inorganic persalt, optionally in conjunction with a peroxyacid bleach precursor. Suitable persalts include sodium perborate monohydrate and tetrahydrate and sodium percarbonate, with sodium percarbonate being most preferred.

Preferred bleach precursors are peracetic acid precursors, such as tetraacetylethylene diamine (TAED); peroxybenzoic acid precursors.

In one preferred aspect, the detergent compositions are free of bleach and of particular utility in the washing of loads containing brightly coloured fabrics.

Low pH/alkalinity detergent compositions

Preferred detergent compositions according to the invention are characterised by having a pH measured as a 1% solution of the detergent composition in distilled water at 25° C. of <10.5, preferably <10.4, most preferably <10.3.

It has been found that compositions having a low level of reserve alkalinity are advantageous in that they have a further reduced tendency to cause the removal of printed pigment from printed cotton fabrics. Reserve alkalinity is expressed as g of NaOH per 100 g of composition as determined by acid titration of a sample, as 1% solution in distilled water to a pH of 9.5. Preferred values of reserve alkalinity are <8.0 g preferably <5.0 g, most preferably <3.0 g NaOH per 100 g of composition.

Physical form

The detergent composition according to the invention may be of any physical type, for example powders, liquids and gels. However, granular and liquid compositions are preferred.

Making process

The detergent compositions of the invention may be prepared by any suitable method. The particulate detergent compositions are suitably prepared by any tower (spray-drying) or non-tower process.

In processes based around a spray-drying tower, a base powder is first prepared by spray-drying a slurry and then other components unsuitable for processing via the slurry can be sprayed on or admixed (postdosed).

The zeolite builder is suitable for inclusion in the slurry, although it may be advantageous for processing reasons for part of the zeolite builder to be incorporated post-tower. The crystalline layered silicate, where this is employed, is also incorporated via a non-tower process and is preferably postdosed.

Alternatively, particulate detergent compositions in accordance with the invention may be prepared by wholly non-tower processes such as granulation.

The granular detergent compositions of the invention may be prepared to any suitable bulk density. The compositions preferably have a bulk density of at least 400 g/l preferably at least 550 g/l, most preferably at least 700 g/l and, with particular preference at least 800 g/l.

The benefits of the present invention are particularly evident in powders of high bulk density, for example, of 700 g/l or above. Such powders may be prepared either by post-tower densification of spray-dried powder, or by wholly non-tower methods such as dry mixing and granulation; in both cases a high-speed mixer/granulator may advantageously be used. Processes using high-speed mixer/granulators are disclosed, for example, in EP340 013A, EP 367 339A, EP 390 251A and EP 420 317A (Unilever).

The detergent composition of the invention may be formulated as a liquid detergent composition which may be aqueous or anhydrous. The term "liquid" used herein includes pasty viscous formulations such as gels. The liquid detergent composition generally has a pH of from 6.5 to 10.5.

The total amount of detergency builder in the liquid composition is preferably from 5 to 70% of the total liquid composition.

Illustrative compositions according to the present invention are presented in the following Examples. In the detergent compositions, the abbreviated component identifications have the following meanings:

24AS: Sodium alkyl sulfate surfactant containing predominantly $C_{12}$ and $C_{14}$ alkyl chains TAS: Sodium alkyl sulfate surfactant containing predominantly $C_{16}$–$C_{18}$ alkyl chains derived from tallow oil.

24AE3S: $C_{12}$–$C_{14}$ alkyl ethoxysulfate containing an average of three ethoxy groups per mole 35E3: A $C_{13-15}$ primary alcohol condensed with an average of3 moles of ethylene oxide 25E3: A $C_{12}$–$C_{15}$ primary alcohol condensed with an average of 3 moles of ethylene oxide Carbonate: Anhydrous sodium carbonate Bicarbonate: Anhydrous sodium bicarbonate Perborate: Sodium perborate tetrahydrate TAED: Tetra acetyl ethylene diamine Silicate: Amorphous Sodium Silicate ($SiO_2$:$Na_2O$ ratio normally follows)

SKS6: Crystalline layered silicate available from Hoechst AG as SKS6 (tradename)

Zeolite MAP: Hydrated sodium aluminosilicate zeolite MAP having a silicon to aluminium ratio of 1.07 having a particle size, expressed as a $d_{50}$ value, of 0.7 micrometers Zeolite A: Hydrated sodium aluminosilicate zeolite A having a particle size, expressed as a $d_{50}$ value, of 0.6 micrometers MA/AA: Copolymer of 1:4 maleic/acrylic acid, average molecular weight about 80,000.

Alcalase: Proteolytic enzyme sold under the tradename Alcalase by Novo Industries A/S (approx 1% enzyme activity by weight)

BSA: Amylolytic enzyme sold under the tradename LE17 by Novo Industries A/S (approx 1% enzyme activity)

EXAMPLE 1

The following granular laundry detergent compositions were prepared (parts by weight) in accordance with the invention.

| | A | B | C | D | E |
|---|---|---|---|---|---|
| 24AS | 7.6 | 6.5 | 4.8 | 6.8 | — |
| TAS | — | — | — | — | 8.6 |
| 24AE3S | 2.4 | — | 1.2 | 1.7 | — |
| 25E3 | 3.26 | — | — | — | 6.3 |
| 35E3 | — | 5.0 | 5.0 | 5.0 | — |
| Zeolite MAP | 20.0 | 25.0 | 25.0 | — | 16.0 |

-continued

| | A | B | C | D | E |
|---|---|---|---|---|---|
| Zeolite A | — | — | — | 25.0 | 15.0 |
| SKS6 | 7.0 | 5.0 | 10.0 | — | — |
| Carbonate | 3.0 | 3.0 | — | — | — |
| Bicarbonate | 3.0 | 4.0 | 4.0 | 8.0 | 5.0 |
| MA/AA | 4.25 | 4.25 | 4.25 | 4.25 | 2.0 |
| Perborate | 16.0 | 16.0 | 16.0 | 16.0 | 20.0 |
| TAED | 5.0 | 5.0 | 5.0 | 5.0 | 6.7 |
| Alcalase | 0.2 | 0.5 | 0.3 | 0.2 | 0.1 |
| BSA | — | — | 0.1 | — | — |
| Protease | 0.04 | 0.08 | — | 0.05 | 0.05 |
| Silicate (2.0 ratio) | 4.0 | — | — | 4.0 | 3.0 |

Water and miscellaneous (Including suds suppressor, sodium sulphate, perfume) to balance The detergent compositions according to the invention, which comprise zeolite builder of larger particle size and bicarbonate builder optionally with relatively low levels of carbonate budder, show good results in stain removal and lower printed cotton fabric damage as compared with a comparably alkaline and built bicarbonate-free composition comprising small particle size zeolite and principally carbonate builder.

What is claimed is:

1. A detergent composition which is free from carbonate builder, said composition containing (a) a zeolite builder having a particle size $d_{50}$ of less than 1.0 micrometers; and (b) a bicarbonate builder;

wherein the weight ratio of the zeolite builder to the bicarbonate builder is from 5:1 to 1:1.

2. A detergent composition according to claim 1, wherein the zeolite builder has a particle size $d_{50}$ of from 0.05 to 0.9 micrometers.

3. A detergent composition according to claim 1, wherein the zeolite builder comprises zeolite P having a silicon to aluminium ratio of not greater than 1.33 (zeolite MAP).

4. A detergent composition according to claim 3, wherein the zeolite MAP has a silicon to aluminium ratio not greater than 1.15.

5. A detergent composition according to claim 1, which comprises from 1 to 80% by weight of the zeolite builder.

6. A detergent composition according to any of claims 1 to 5, wherein said bicarbonate builder is present at a level of from 0.5% to 60% by weight of the detergent composition.

7. A detergent composition according to claim 1, wherein the bicarbonate builder is sodium bicarbonate.

8. A detergent composition according to claim 1, wherein the composition has a reserve alkalinity (expressed as g of NaOH per 100 g of composition as determined by acid titration of a sample as 1% solution in distilled water to a pH of 9.5) of less than 8.0 g.

9. A detergent composition according to claim 1, which is free of bleach or optical brightener.

10. A detergent composition according to claim 1 wherein the detergent composition further comprises an amylolytic enzyme.

* * * * *